US010249964B1

(12) United States Patent
Wu

(10) Patent No.: US 10,249,964 B1
(45) Date of Patent: Apr. 2, 2019

(54) TERMINAL BLOCK

(71) Applicants: DINKLE ENTERPRISE CO., LTD., New Taipei (TW); DINKLE ELECTRIC MACHINERY (CHINA) CO., LTD., Kunshan, Jiangsu (CN)

(72) Inventor: Shang-Tsai Wu, New Taipei (TW)

(73) Assignees: DINKLE ENTERPRISE CO., LTD., New Taipei (TW); DINKLE ELECTRIC MACHINERY (CHINA) CO., LTD., Kunshan, Jiangsu (CN)

( * ) Notice: Subject to any disclaimer, the term of this patent is extended or adjusted under 35 U.S.C. 154(b) by 0 days.

(21) Appl. No.: 15/893,900

(22) Filed: Feb. 12, 2018

(51) Int. Cl.
*H01R 9/24* (2006.01)
*H01R 12/51* (2011.01)

(52) U.S. Cl.
CPC ..... *H01R 9/2425* (2013.01); *H01R 9/2475* (2013.01); *H01R 12/515* (2013.01)

(58) Field of Classification Search
CPC ... H01R 9/2425; H01R 9/2475; H01R 12/515
See application file for complete search history.

(56) References Cited

U.S. PATENT DOCUMENTS 4,924,213 A 5/1990 Decho et al.
5,755,822 A * 5/1998 Scheffner ..... H01R 13/717 439/490
6,050,845 A 4/2000 Smalley, Jr. et al.
6,464,533 B1 * 10/2002 Ma ..... H01R 13/6641 439/490
6,913,481 B2 * 7/2005 Marshall ..... H01R 24/64 439/490

(Continued)

FOREIGN PATENT DOCUMENTS

CN 103999293 B 3/2017
DE 3233153 A1 3/1984

(Continued)

OTHER PUBLICATIONS

Office Action dated Mar. 31, 2018 of the corresponding Taiwan patent application.

(Continued)

*Primary Examiner* — Truc T Nguyen
(74) *Attorney, Agent, or Firm* — Chun-Ming Shih; HDLS IPR Services

(57) ABSTRACT

A terminal block for coupling with at least one conductive wire includes an insulation base (100) and a circuit board (200). A docking chamber (101) is defined in the insulation base (100), multiple connecting holes (102) for inserting the respective conductive wires and multiple through holes (103) corresponding to the respective connecting holes (102) are defined on a lateral surface of the insulation base (100). The respective through holes (103) are communicated with the docking chamber (101) and adjacent to the respective corresponding connecting holes (102). The circuit board (200) is arranged in the docking chamber (101), and multiple LEDs (210) are arranged on the circuit board (200) corresponding to the respective through holes (103). The LEDs (210) are accommodated in the docking chamber (101), and the respective LEDs (210) are able to illuminate through the respective corresponding through holes (103).

10 Claims, 5 Drawing Sheets

(56) References Cited

U.S. PATENT DOCUMENTS

| | | | | |
|---|---|---|---|---|
| 7,125,280 | B1 * | 10/2006 | Lee | H01R 13/717 439/490 |
| 7,780,468 | B1 | 8/2010 | Bishop | |
| 2008/0153344 | A1 * | 6/2008 | Horst | H01R 4/4818 439/427 |
| 2008/0248661 | A1 * | 10/2008 | Costello | H05K 1/184 439/79 |
| 2008/0248698 | A1 | 10/2008 | Pizzi | |
| 2009/0253293 | A1 * | 10/2009 | Zhang | H01R 13/6658 439/541.5 |
| 2010/0055973 | A1 * | 3/2010 | Yang | H01R 13/6658 439/490 |
| 2014/0024269 | A1 * | 1/2014 | Decker | H01R 4/4818 439/733.1 |
| 2015/0024640 | A1 * | 1/2015 | Yamada | H01R 13/2442 439/786 |
| 2015/0194745 | A1 * | 7/2015 | Moser | H01R 4/4836 439/55 |
| 2015/0333463 | A1 * | 11/2015 | Mochizuki | H01R 9/2425 439/121 |

FOREIGN PATENT DOCUMENTS

| | | | |
|---|---|---|---|
| EP | 2595251 | A1 | 5/2013 |
| TW | 201528629 | A | 7/2015 |
| WO | 2014124475 | A2 | 8/2014 |
| WO | 2017097591 | A1 | 6/2017 |

OTHER PUBLICATIONS

Search Report dated Jul. 26, 2018 of the corresponding European patent application.

* cited by examiner

TERMINAL BLOCK

TECHNICAL FIELD

The present disclosure relates to a terminal block, in particular to a terminal block which is able to illuminate for indicating.

BACKGROUND

Light sources are commonly arranged on a conventional terminal block for indicating electrical connection status of the terminal block. In general, the terminal block includes a circuit board and an insulation base arranged on the circuit board, coupling openings are defined on the insulation base. In order to arrange the lights adjacent to the respective coupling openings for indicating electrical connection status of the corresponding coupling opening, a light source and corresponding light guiding structures are commonly disposed on the circuit board, and the light guiding structures extending to the respective corresponding coupling openings are arranged on the insulation base. When the insulation base is assembled onto the circuit board, light guiding structures on the circuit board are connected to the respective corresponding light guiding structures on the insulation base, and the light source is thereby guided to the respective coupling opening.

However, a large part of space in the terminal block is occupied by the terminal block light guiding structures although the light guiding structures are not big, because the terminal block is tiny. Therefore, a volume of the terminal block is difficult to be decreased.

In views of this, in order to solve the above disadvantage, the present inventor studied related technology and provided a reasonable and effective solution in the present disclosure.

SUMMARY

A terminal block which is able to illuminate for indicating is provided in the present disclosure.

A terminal block including an insulation base and a circuit board is provided in the present disclosure for coupling with at least one conductive wire. A docking chamber is defined in the insulation base, multiple connecting holes for inserting the respective conductive wires therein and multiple through holes corresponding to the respective connecting holes are defined on a lateral surface of the insulation base. The respective through holes are communicated with the docking chamber and adjacent to the respective corresponding connecting holes. The circuit board is arranged in the docking chamber, and multiple LEDs are arranged on the circuit board corresponding to the respective through holes. The LEDs are accommodated in the docking chamber and the respective LEDs are able to illuminate through the respective corresponding through holes.

According to the terminal block of the present disclosure, an opening is defined on the docking chamber and the circuit board could cover the opening. The respective through holes are defined on an edge of the opening, and the circuit board covers one side of the openings. the circuit board could alternatively be inserted into the docking chamber through the opening.

According to the terminal block of the present disclosure, corresponding to each connecting hole, a conductive point is arranged on the circuit board and the conductive points are accommodated in the docking chamber, and corresponding to each connecting hole, a terminal is arranged in the insulation base and the respective terminals are extended into the docking chamber and electrically connected with the respective corresponding the conductive points. The respective terminals could be coupled with the respective corresponding conductive points, or the respective terminals could alternatively press on the respective corresponding conductive points. The conductive points are arranged on one surface of the circuit board, and the LEDs are arranged on the other surface of the circuit board. Alternatively, the conductive points and the LEDs can be arranged on the same surface of the circuit board. The respective terminals are extended into the respective corresponding connecting holes for electrically connecting with the conductive wires. At least a partition plate is arranged in the docking chamber, and the terminals are thereby isolated from each other.

According to the terminal block of the present disclosure, the through holes are defined on the insulation base and the LEDs are arranged corresponding to the respective through holes, and the respective LEDs are thereby able to illuminate from the insulation base through the respective corresponding through hole for indicating an electrical connection status of the terminal block. Therefore, a light guiding structure should not be arranged in the terminal block according to the present disclosure, and a volume of the terminal block could be decreased.

BRIEF DESCRIPTION OF DRAWING

The present disclosure can be more fully understood by reading the following detailed description of the embodiment, with reference made to the accompanying drawings as follows.

DETAILED DESCRIPTION

Figure 1:
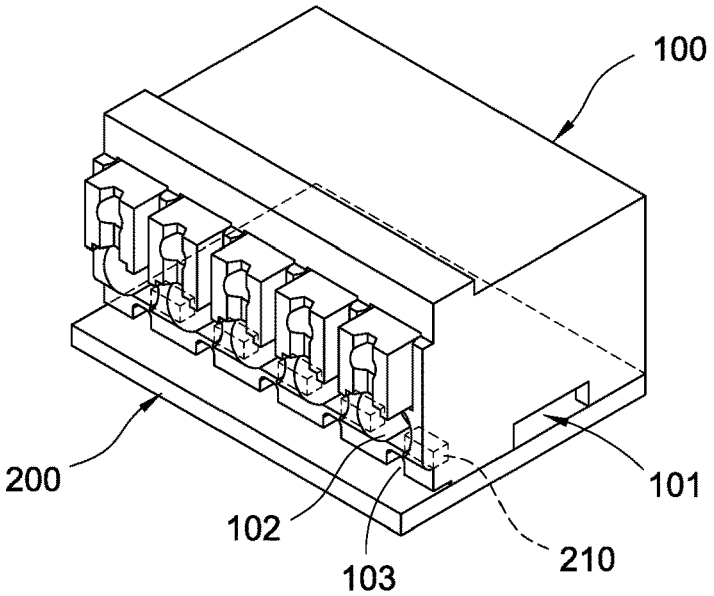
FIG. 1 is a perspective view showing a first embodiment of the terminal block of the present disclosure.
Figure 2:
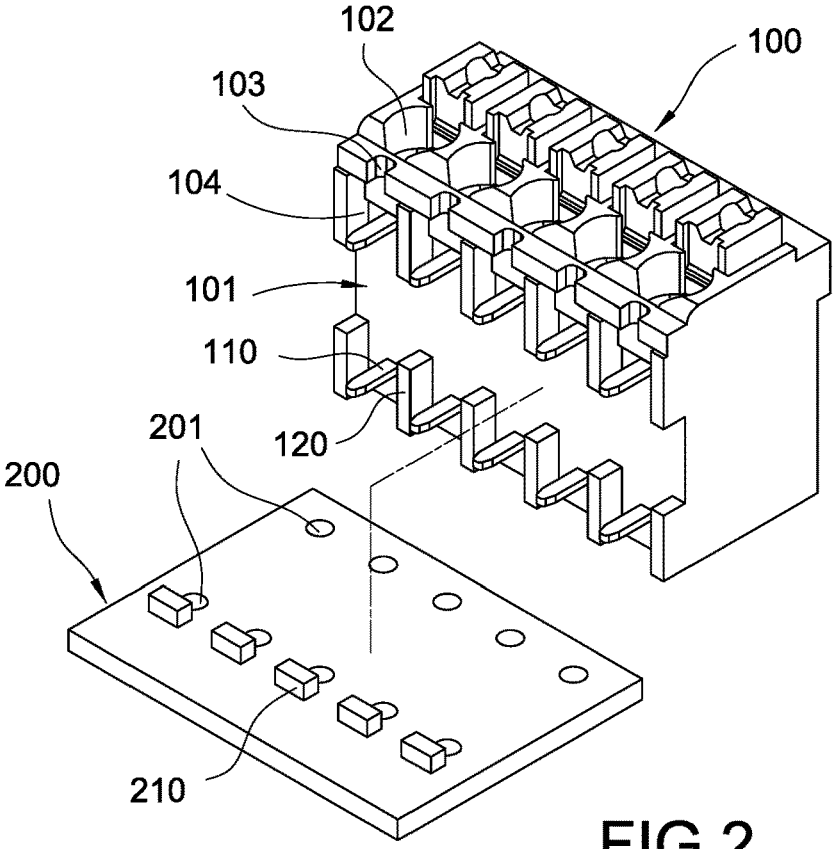
FIG. 2 is an exploded view showing the first embodiment of the terminal block of the present disclosure.
Figure 3:
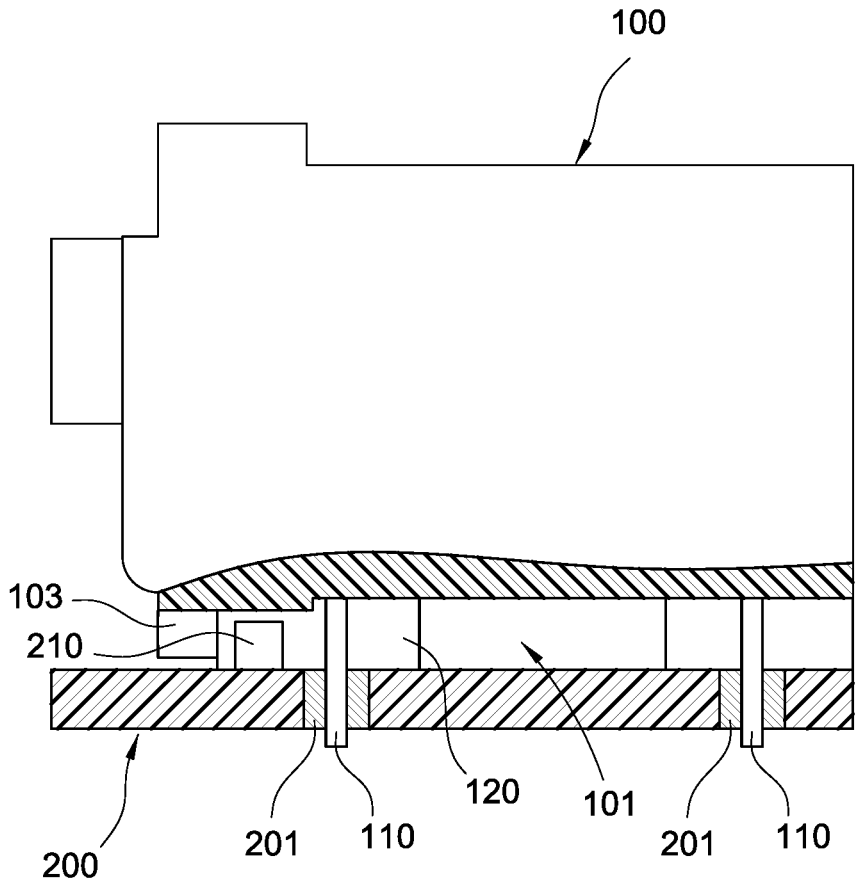
FIG. 3 is a cross-sectional view showing the first embodiment of the terminal block of the present disclosure.

According to a first embodiment of the present disclosure shown in FIGS. 1 to 3, a terminal block for coupling with at least a conductive wire (not be shown in Figs.) and further electrically connected to a predetermined element or device is provided. the terminal block according to the present disclosure includes an insulation base 100 and a circuit board 200.

According to the present embodiment, the insulation base 100 is preferably a rectangular plastic block. a concave docking chamber 101 is defined on a bottom of the insulation base 100 and an opening 104 communicated with the docking chamber 101 is defined on the bottom of the insulation base 100, and multiple connecting holes 102 and multiple through holes 103 corresponding to the respective connecting holes 102 are defined on a front surface of the insulation base 100. The respective through holes 103 are defined on an edged of the opening 104 communicated with the docking chamber 101, the respective through holes 103 are notches. Each connecting hole 102 is allowed a conductive wire to be inserted thereinto, the respective through holes 103 are communicated with the docking chamber 101 and arranged adjacent to the respective corresponding connecting holes 102.

The circuit board 200 is arranged in the docking chamber 101, according to the present embodiment, the circuit board 200 is preferably arranged on the bottom of the insulation base 100 to cover the opening 104 of the docking chamber 101, and the circuit board 200 covers one side of each through hole 103 and each through hole 103 is thereby closed to be defined as a hole. corresponding to each through hole 103, a LED 210 is arranged on the circuit board 200, and the LEDs 210 are accommodated in the docking chamber 101 and each LED 210 could illuminate through the respective through hole 103.

Corresponding to each connecting hole 102, a conductive point 201 is arranged on the circuit board 200, and the conductive points 201 are accommodated in the docking chamber 101; corresponding to each connecting hole 102, a terminal 110 is arranged in the insulation base 100, and the respective terminal 110 are extended into the respective corresponding docking chamber 101 and thereby electrically connected with the respective corresponding conductive points 201; and the respective terminals 110 are additionally extended into the respective corresponding connecting holes 102 for electrically connecting with the conductive wires. The conductive wires are electrically connected to the circuit board 200 via the terminals 110. According to the present embodiment, each conductive point 201 is a copper welding hole, the respective terminals 110 are inserted in the respective corresponding conductive point 201, and at least a partition plate 120 could be arranged in the docking chamber 101 for isolating the terminals 110 from each other.

Figure 4:
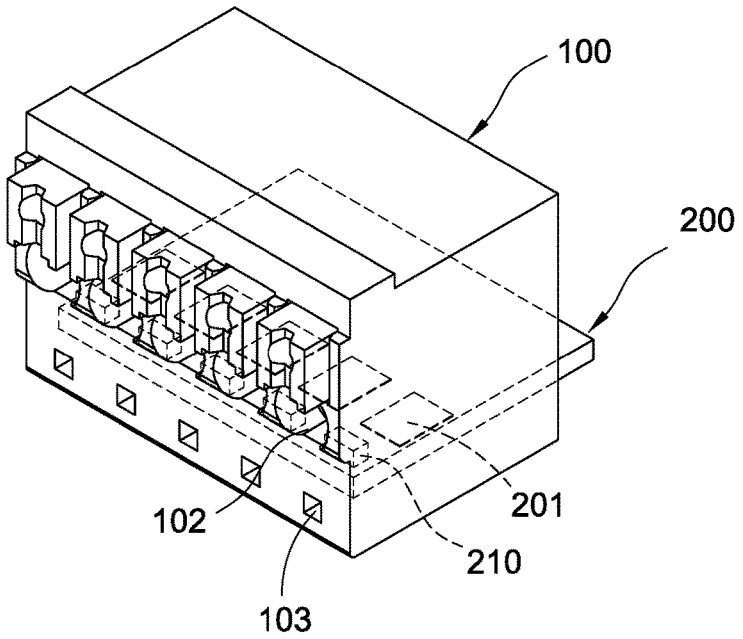
FIG. 4 is a perspective view showing a second embodiment of the terminal block of the present disclosure.
Figure 5:
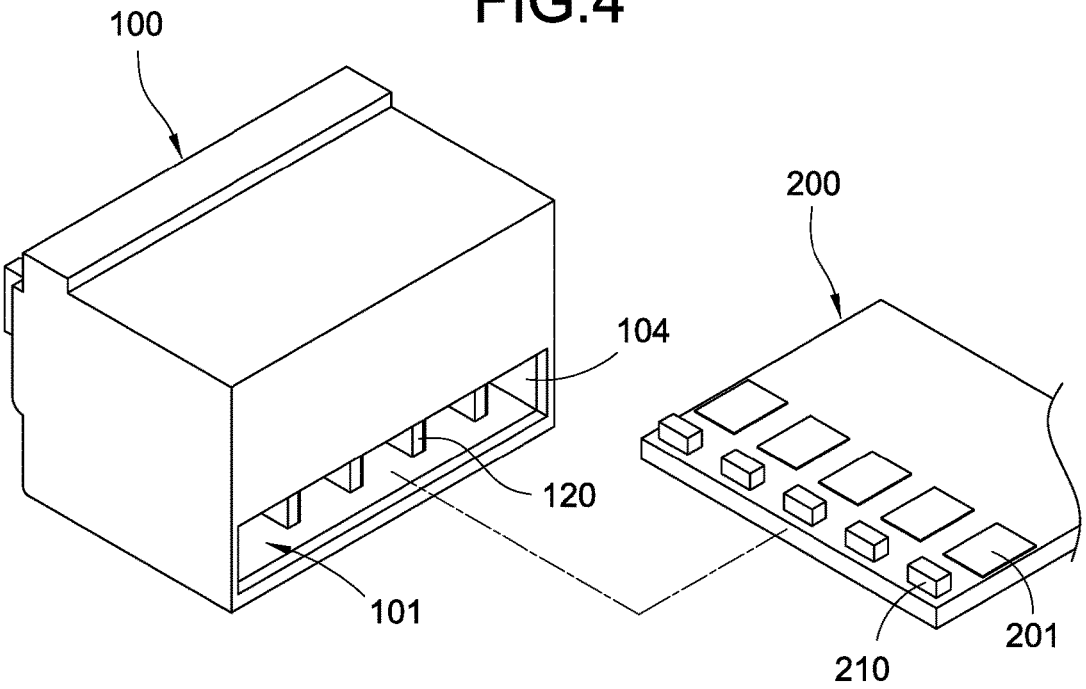
FIG. 5 is an exploded view showing the second embodiment of the terminal block of the present disclosure.
Figure 6:
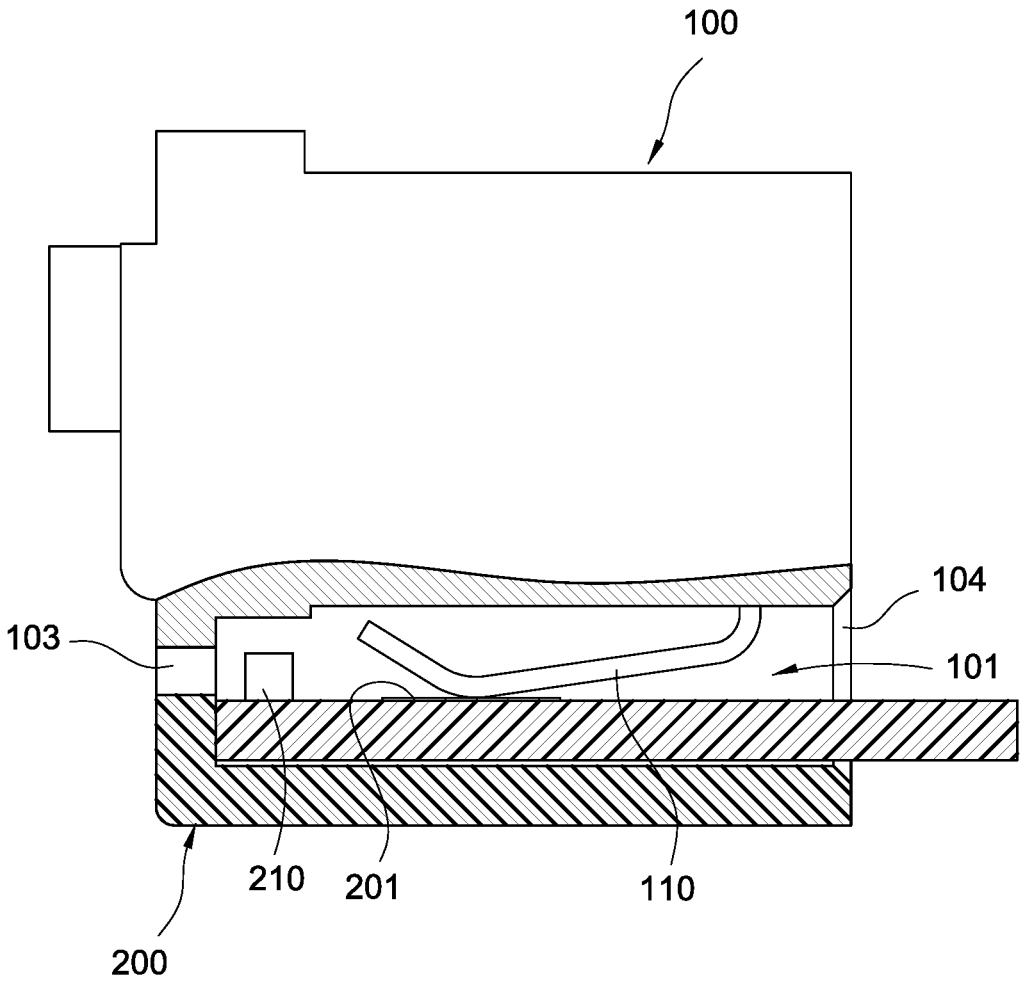
FIG. 6 is a cross-sectional view showing the second embodiment of the terminal block of the present disclosure.

According to a second embodiment shown in FIGS. 4 to 6, a terminal block is provided in the present embodiment, and the same as the first embodiment, the terminal block is used for coupling with at least a conductive wire and further electrically connected to a predetermined element or device is provided. According to the present disclosure, the terminal block includes an insulation base 100 and a circuit board 200, and the structure thereof is similar to the first embodiment and will not be repeated. The differences between the present embodiment and the first embodiment are described below.

According to the present embodiment, an opening 104 communicated with the docking chamber 101 is defined on a back surface of the insulation base 100, and the is inserted into the docking chamber 101 through the opening 104. However, scope of the present disclosure should not be limited to the embodiments, for example, the opening 104 alternatively could be defined on another lateral surface. According to the present embodiment, each conductive point 201 is a gold finger, the respective terminals 110 press on the respective corresponding conductive points 201 when the circuit board 200 is inserted in the docking chamber 101. According to the present embodiment, the conductive points 201 and the LEDs 210 are preferably arranged on the same surface of the circuit board 200.

Figure 7:
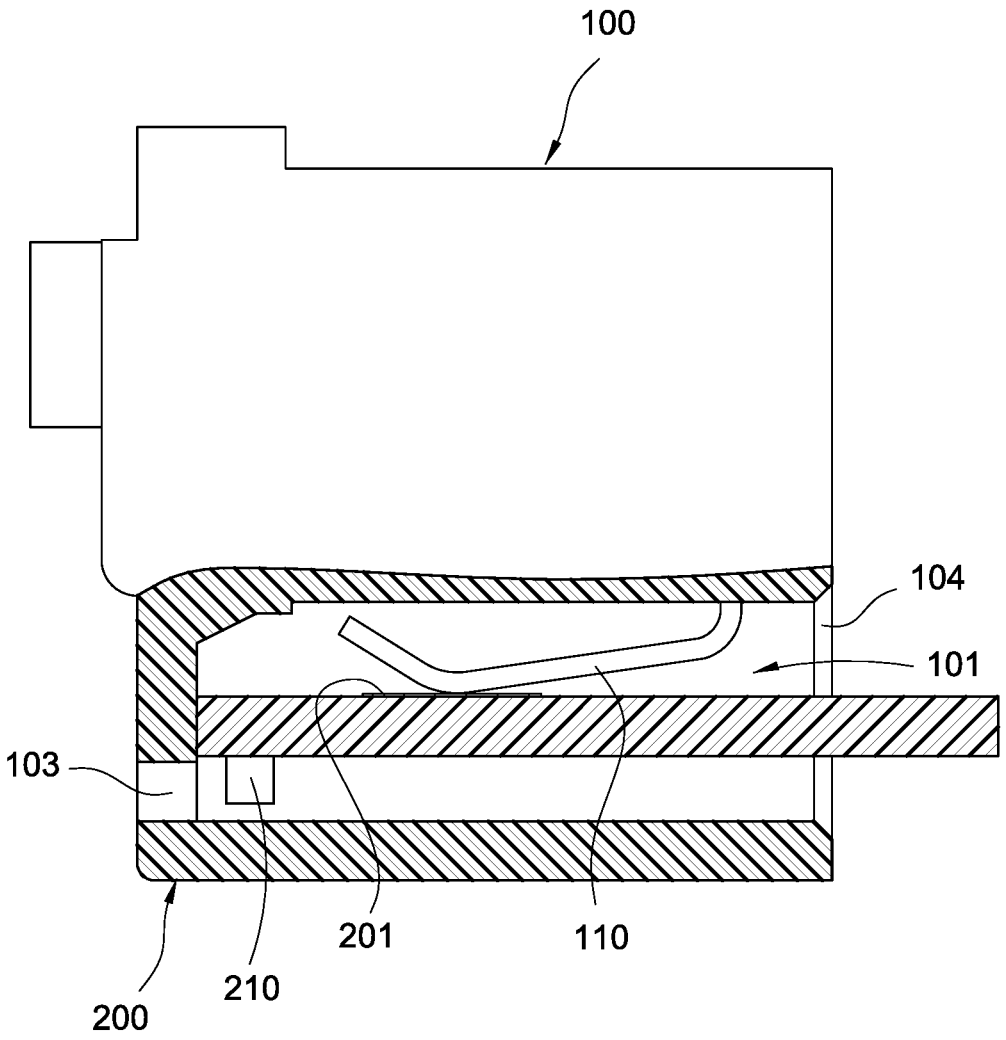
FIG. 7 is a perspective view showing another arrangement of the second embodiment of the terminal block of the present disclosure.

According to another alternative arrangement shown in FIG. 7, the conductive points 201 are arranged on one surface of the circuit board 200, and the LEDs 210 are arranged on the other surface of the circuit board 200.

According to the present disclosure terminal block, through holes 103 are defined on the insulation base 100 and the LEDs 210 are arranged corresponding to the respective through holes 103, and the respective LEDs 210 are thereby able to directly illuminate from the insulation base 100 through the respective through hole 103 for indicating an electrical connection status of the terminal block. Therefore, a light guiding structure should not be arranged in the terminal block according to the present disclosure, and a volume of the terminal block could be decreased.

Although the present disclosure has been described with reference to the foregoing preferred embodiment, it will be understood that the disclosure is not limited to the details thereof. Various equivalent variations and modifications can still occur to those skilled in this art in view of the teachings of the present disclosure. Thus, all such variations and equivalent modifications are also embraced within the scope of the present disclosure as defined in the appended claims.

What is claimed is:

1. A terminal block for coupling with at least a conductive wire, the terminal block comprising:

an insulation base (100), a docking chamber (101) being defined in the insulation base (100), a plurality of connecting holes (102) for coupling with the conductive wire and a plurality of through holes (103) corresponding to the respective connecting holes (102) being defined on a lateral surface of the insulation base (100), the respective through holes (103) being communicated with the docking chamber (101) and arranged adjacent to the respective corresponding connecting holes (102); and a circuit board (200) arranged under the insulation base (100) and outside the docking chamber (101), a plurality of LEDs (210) corresponding to the respective through holes (103) being arranged on the circuit board (200), the LEDs (210) being accommodated in the docking chamber (101) and the respective LEDs (210) being able to illuminate through the respective through holes (103), wherein an opening (104) is defined on the docking chamber (101) and the circuit board (200) is inserted into the docking chamber (101) through the opening (104).

2. The terminal block according to claim 1, wherein an opening (104) is defined on the docking chamber (101) and the circuit board (200) covers the opening (104).

3. The terminal block according to claim 2, wherein the respective through holes (103) are defined on an edge of the opening (104), and the circuit board (200) covers one side of the openings (104).

4. A terminal block for coupling with at least a conductive wire, the terminal block comprising:

an insulation base (100), a docking chamber (101) being defined in the insulation base (100), a plurality of connecting holes (102) for coupling with the conductive wire and a plurality of through holes (103) corresponding to the respective connecting holes (102) being defined on a lateral surface of the insulation base (100), the respective through holes (103) being communicated with the docking chamber (101) and arranged adjacent to the respective corresponding connecting holes (102); and a circuit board (200) arranged under the insulation base (100) and outside the docking chamber (101), a plurality of LEDs (210) corresponding to the respective through holes (103) being arranged on the circuit board (200), the LEDs (210) being accommodated in the docking chamber (101) and the respective LEDs (210) being able to illuminate through the respective through holes (103), wherein, corresponding to each connecting hole (102), a conductive point (201) is arranged on the circuit board (200) and the conductive points (201) are accommodated in the docking chamber (101), and corresponding to each connecting hole (102), a terminal (110) is arranged in the insulation base (100) and the respective terminals (110) are extended into the docking chamber (101) and electrically connected with the corresponding conductive points (201).

5. The terminal block according to claim 4, wherein the respective terminals (110) are coupled with the corresponding conductive points (201).

6. The terminal block according to claim 4, wherein the respective terminals (110) press on the corresponding conductive points (201).

7. The terminal block according to claim 4, wherein the conductive points (201) are arranged on one surface of the circuit board (200), and the LEDs (210) are arranged on the other surface of the circuit board (200).

8. The terminal block according to claim 4, wherein the conductive points (201) and the LEDs (210) are arranged on the same surface of the circuit board (200).

9. The terminal block according to claim 4, wherein the respective terminals (110) are extended into the corresponding connecting holes (102) for electrically connecting with the conductive wires.

10. The terminal block according to claim 4, wherein at least a partition plate (120) is arranged in the docking chamber (101), and the terminals (110) are thereby isolated from each other.

* * * * *